US012359296B2

(12) United States Patent
Da Silva et al.

(10) Patent No.: US 12,359,296 B2
(45) Date of Patent: Jul. 15, 2025

(54) DEVICE FOR REMOVING MATTES FROM THE SURFACE OF A LIQUID METAL BATH INSIDE A DUCT OF A LINE FOR CONTINUOUSLY COATING A METAL STRIP

(71) Applicant: FIVES STEIN, Maisons-Alfort (FR)

(72) Inventors: Fernando Da Silva, Maisons-Alfort (FR); Timothée Laloy, Maisons-Alfort (FR); Pascal Thevenet, Maisons-Alfort (FR)

(73) Assignee: FIVES STEIN, Maisons-Alfort (FR)

( * ) Notice: Subject to any disclaimer, the term of this patent is extended or adjusted under 35 U.S.C. 154(b) by 399 days.

(21) Appl. No.: 17/788,793

(22) PCT Filed: Dec. 11, 2020

(86) PCT No.: PCT/FR2020/052387
§ 371 (c)(1),
(2) Date: Jun. 24, 2022

(87) PCT Pub. No.: WO2021/130422
PCT Pub. Date: Jul. 1, 2021

(65) Prior Publication Data

US 2023/0034415 A1 Feb. 2, 2023

(30) Foreign Application Priority Data

Dec. 26, 2019 (FR) ..... 1915599

(51) Int. Cl.
*C23C 2/00* (2006.01)
*C23C 2/40* (2006.01)

(52) U.S. Cl.
CPC ..... *C23C 2/526* (2022.08); *C23C 2/0034* (2022.08); *C23C 2/00342* (2022.08);
(Continued)

(58) Field of Classification Search
CPC ..... C23C 2/0034; C23C 2/00342; C23C 2/00348
See application file for complete search history.

(56) References Cited

U.S. PATENT DOCUMENTS 3,914,481 A * 10/1975 Bostroem ..... C23C 2/02 118/422
4,361,448 A * 11/1982 Sippola ..... C23C 2/00344 148/637

(Continued)

FOREIGN PATENT DOCUMENTS

CN 109988986 A1 7/2019
EP 2092281 A1 8/2009

(Continued)

OTHER PUBLICATIONS

International Search Report issued in PCT/FR2020/052387, mailed Feb. 15, 2021, pp. 1-4, including English translation.

(Continued)

*Primary Examiner* — Jason L Vaughan
(74) *Attorney, Agent, or Firm* — The Belles Group, P.C.

(57) ABSTRACT

Disclosed is a device for removing mattes from the surface of a liquid metal bath inside a duct of a line for continuously coating a metal strip having first and second faces, the first face being intended to come into contact with a bottom roller, comprising a compartment via which the liquid metal inside the duct is replenished by being drawn off by a pump to which the compartment is connected, characterized in that the compartment is capable of being removed by disassembly means without the metal strip needing to be cut.

10 Claims, 3 Drawing Sheets

(52) U.S. Cl.
CPC ..... *C23C 2/00344* (2022.08); *C23C 2/00361* (2022.08); *C23C 2/325* (2022.08); *C23C 2/40* (2013.01); *C23C 2/524* (2022.08)

(56) References Cited

U.S. PATENT DOCUMENTS

| | | | | |
|---|---|---|---|---|
| 4,752,508 | A * | 6/1988 | Sippola | C23C 2/0034 427/431 |
| 4,971,842 | A * | 11/1990 | Sippola | C23C 2/00344 427/433 |
| 5,135,893 | A * | 8/1992 | Dohi | C23C 2/0034 501/91 |
| 5,863,314 | A * | 1/1999 | Morando | B01F 25/312 266/228 |
| 8,475,594 | B2 * | 7/2013 | Bright | C23C 2/00344 427/337 |
| 9,745,653 | B2 * | 8/2017 | Schaffrath | C23C 2/00344 |
| 10,941,474 | B2 * | 3/2021 | Saint-Raymond | C22C 18/04 |
| 11,149,336 | B2 * | 10/2021 | Veg | C23C 2/52 |
| 11,584,980 | B2 | 2/2023 | Garcia Martino et al. | |
| 11,692,257 | B2 * | 7/2023 | Garcia Martino | C23C 2/0224 148/529 |
| 2004/0052958 | A1 * | 3/2004 | Dauchelle | C23C 2/00344 118/100 |
| 2019/0062888 | A1 * | 2/2019 | Saint-Raymond | C22C 18/04 |
| 2019/0144982 | A1 * | 5/2019 | Veg | C23C 2/004 118/400 |
| 2020/0399749 | A1 | 12/2020 | Garcia Martino et al. | |
| 2021/0180171 | A1 | 6/2021 | Garcia Martino et al. | |
| 2022/0106674 | A1 * | 4/2022 | Moon | C23C 2/00342 |
| 2022/0290283 | A1 | 9/2022 | Saint-Raymond et al. | |

FOREIGN PATENT DOCUMENTS

| | | | |
|---|---|---|---|
| EP | 4028566 | A1 | 7/2022 |
| JP | H08269659 | A | 10/1996 |
| JP | 2000273599 | A | 10/2000 |
| JP | 4120258 | B2 | 7/2008 |
| WO | 2008067620 | A1 | 6/2008 |
| WO | 2019175684 | A1 | 9/2019 |
| WO | 2019224584 | A1 | 11/2019 |
| WO | 2021130422 | A1 | 7/2021 |

OTHER PUBLICATIONS

Third party observations against European Patent Application No. EP 4 081 699, issued Apr. 20, 2023.

* cited by examiner

[Fig. 1]
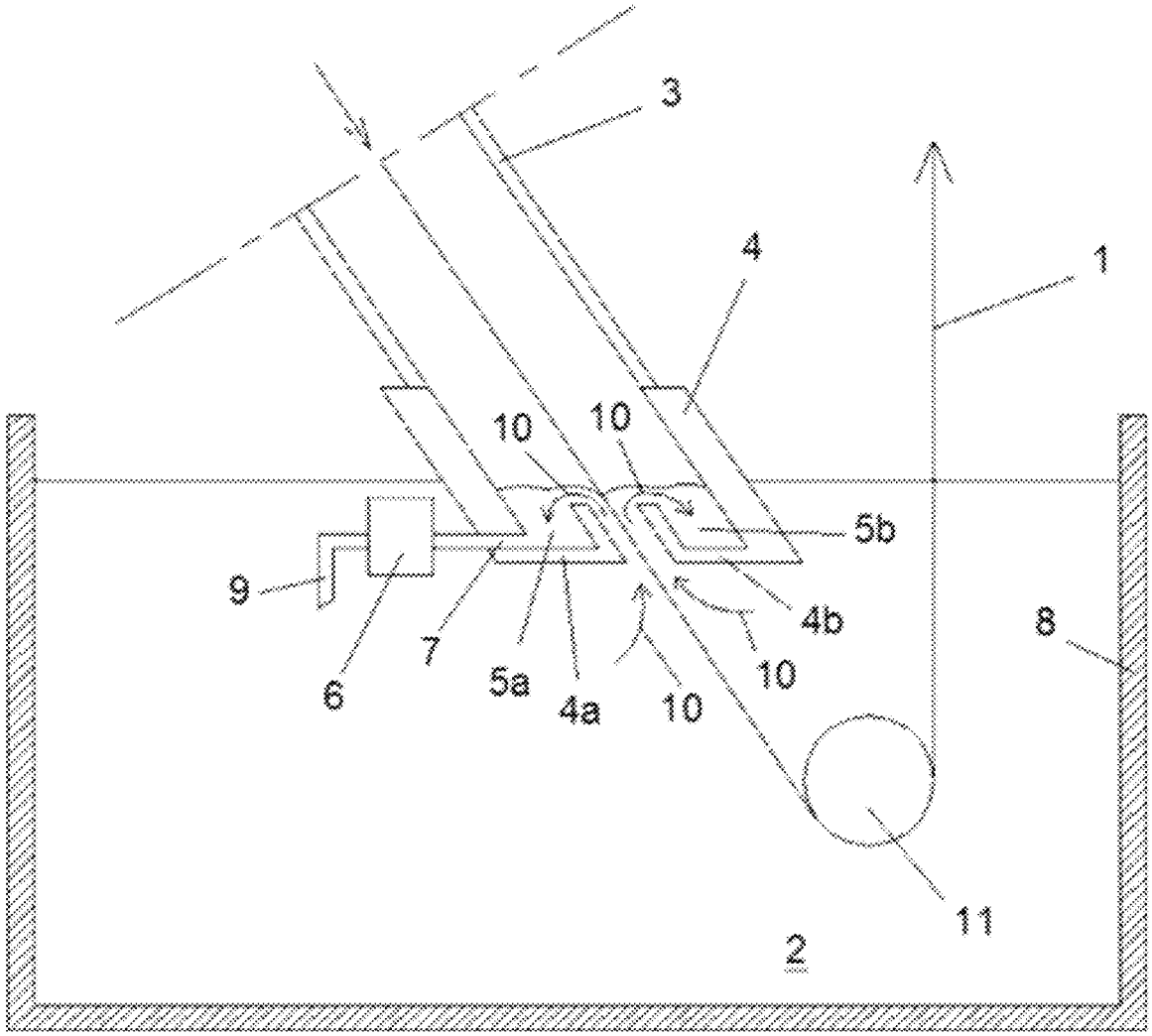

[Fig. 2]
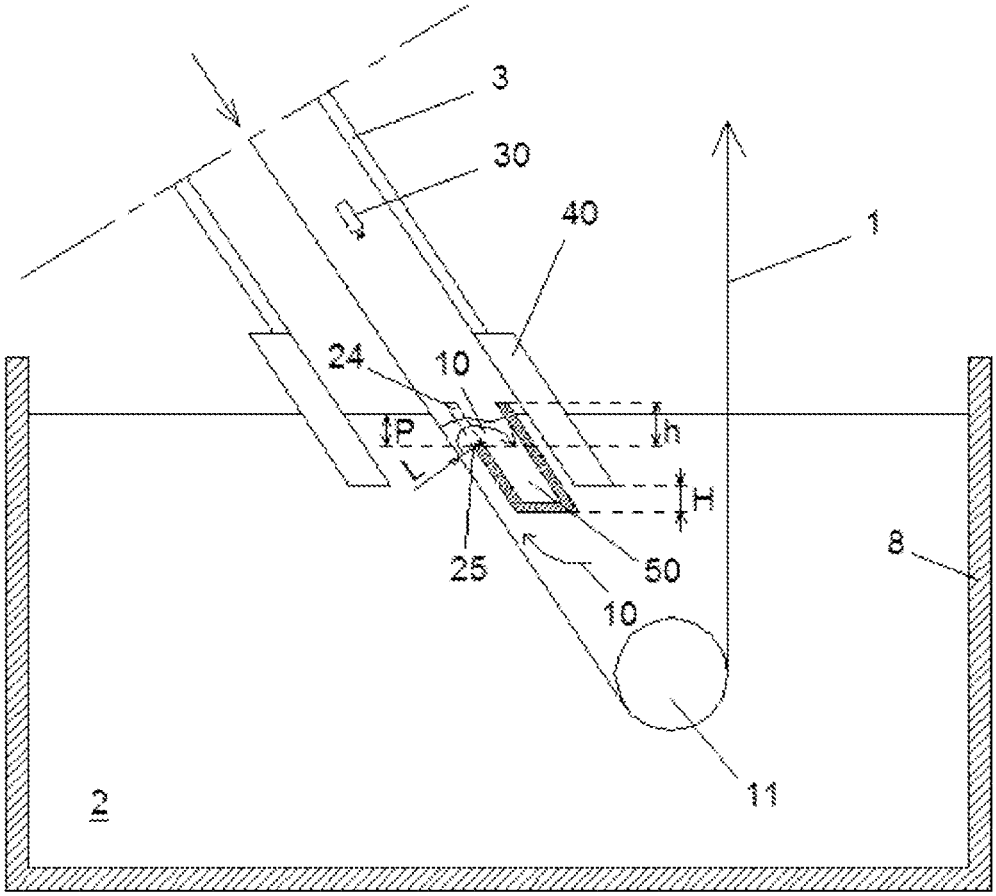

[Fig. 3]
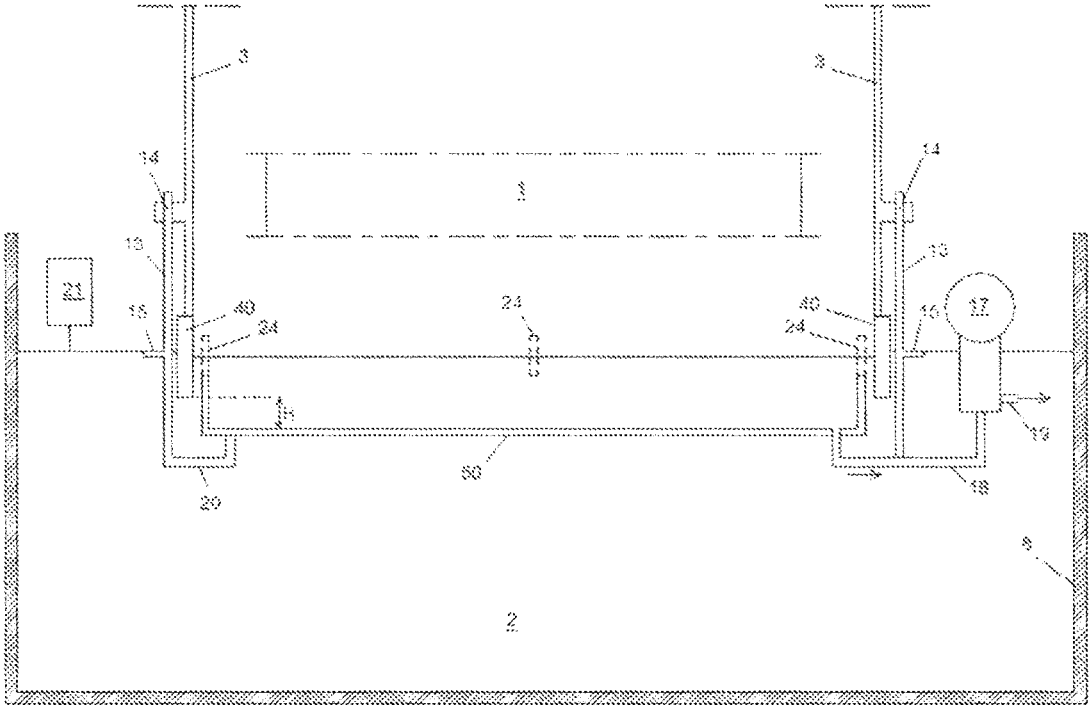
[Fig. 4]
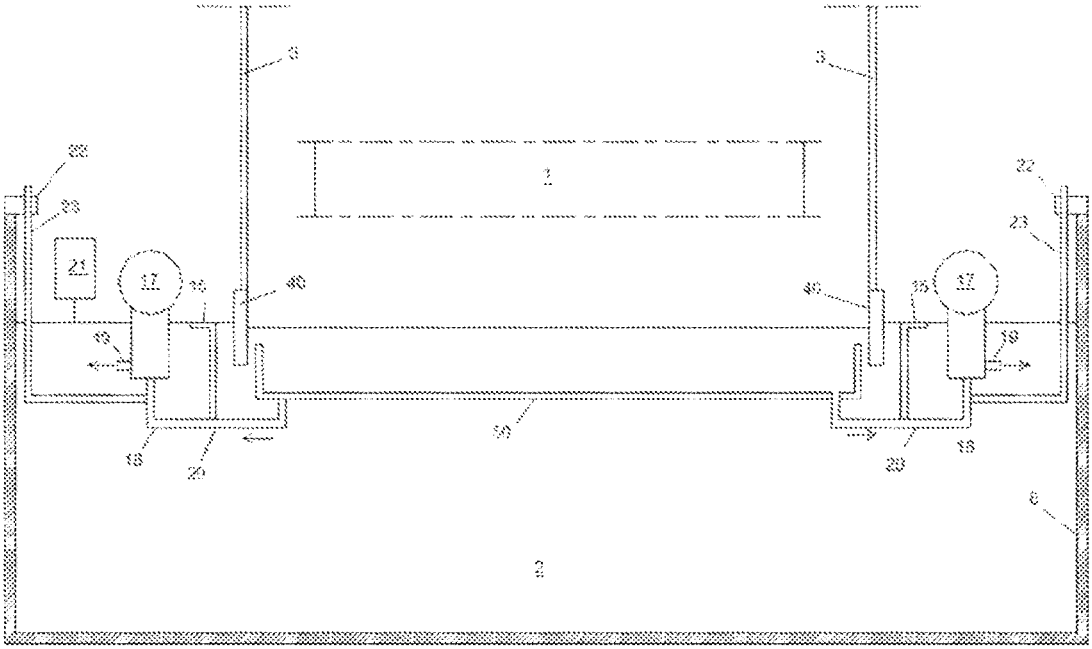

DEVICE FOR REMOVING MATTES FROM THE SURFACE OF A LIQUID METAL BATH INSIDE A DUCT OF A LINE FOR CONTINUOUSLY COATING A METAL STRIP

CROSS-REFERENCE TO RELATED PATENT APPLICATIONS

The present application is a U.S. national stage application under 35 U.S.C. § 371 of PCT Application No. PCT/FR2020/052387 filed Dec. 11, 2020, which claims priority to French Patent Application No. 1915599 filed Dec. 26, 2019. The disclosures of the aforementioned priority applications are incorporated herein by reference in their entireties.

DESIGNATION OF THE RELEVANT TECHNICAL FIELD

The invention relates to continuous hot-dip coating installations for a metal strip. It finds its place in continuous sheet processing lines, in particular annealing and galvanizing lines.

Technical Problems Addressed by the Invention

A dip coating line is schematically composed, from the entrance thereof, of a heating section, a cooling section, a coating section in which the strip is immersed in a molten metal bath contained in a pot, for example zinc or an alloy based on zinc, aluminum, silicon or magnesium, and a cooling tower allowing the solidification of the metal on the strip and the cooling of the latter to ambient temperature.

Thus, after having undergone a heat treatment comprising heating and cooling in an annealing furnace under a controlled reducing atmosphere, a mixture of nitrogen and hydrogen, the strip is protected from external attacks by immersion in a molten metal bath in a continuous process. On leaving the bath, the coating coats the sheet, which can then be exposed to the air without risk of oxidation. For galvanizing, the bath temperature is around 460° C. The strip has substantially this temperature when it is immersed in the bath.

The connection between the furnace and the coating bath is made by a duct, which is a tunnel that dips into the pot of molten metal and thus ensures the sealed connection between the furnace and the bath. The end of this duct that dips into the bath is a consumable part due to corrosion by the molten metal. It is characterized by a thick sheet thickness in order to prolong its life in view of corrosion. This consumable part will be referred to as "shoe" in the rest of the description.

A roller immersed in the molten metal, called the bottom roller, allows the deflection of the strip to cause it to exit vertically from the pot and to pass through the cooling tower.

Many ducts are equipped with a pivoting movement allowing the use of bottom rollers of different diameters. They are also equipped with a retraction movement allowing the shoe to be removed from the molten metal for maintenance operations.

The strip passing through the pot carries molten metal with it, which results in a lowering of the level. Maintenance of the level is managed by an external supply in the form of solid blocks introduced into the pot.

Surface mattes, which are metal oxides, in particular zinc oxides, intermetallic compounds or complex agglomerates, create a film of solid matter on the surface of the zinc pot.

These mattes can end up in the shoe; they are then carried along by the strip into the molten metal and become stuck between the bottom roller and the strip. When passing over the bottom roller, the mattes punch the strip and create a spur on the other face. These surface defects on the strip make it unsuitable for use for demanding applications in terms of surface quality, for example for the exposed sheets of automobiles.

TECHNICAL BACKGROUND

To remedy the problem of surface mattes being carried along with the strip, several surface cleaning solutions inside the shoe have been invented.

For example, JP04120258 describes a shoe containing, at its lower end and inside the latter, a reservoir on the circumference of the shoe, thus going around the strip, in which the molten metal is sucked by a recirculation pump before being released inside the pot. The renewal of the molten metal inside the shoe makes it possible to remove the mattes outside of it. The reservoir is formed by an extension of the outer walls of the shoe toward the inside of the shoe.

FIG. 1 illustrates, schematically and in side section, a coating section according to the state of the art. A strip 1 is immersed in the bath 2 of molten metal inside a duct 3 comprising a shoe 4 at its lower end. The lower end of the shoe comprises two reservoirs 5*a*, 5*b*, each disposed on either side of the strip and connected by their ends. These reservoirs are formed by two extensions 4*a*, 4*b* of the outer walls of the shoe. A recirculation pump 6 draws in the molten metal from the reservoirs 5*a*, 5*b* through an orifice 7 and pushes it back into the pot 8 through a pipe 9. Arrows 10 illustrate the flow of molten metal in the vicinity and in the shoe. Inside the pot, the strip wraps around a bottom roller 11, which brings it back to a vertical plane for its exit from the bath. A device, not shown in this figure, makes it possible to capture and remove the mattes present in the pot, outside the shoe, these being mainly on the surface of the bath.

A first drawback of these solutions according to the state of the art is that the reservoir is part of the shoe, the shoe and its reservoir being one and the same. It is thus imperative to cut the strip for reservoir cleaning operations, which then leads to a long downtime of the line.

A second drawback of these solutions is that no adjustment is possible between the internal reservoir and the shoe to obtain precise geometric adjustment of the reservoir relative to the surface of the bath in the shoe. This is particularly troublesome in the case where the shoe comprises two internal reservoirs, one on each side of the strip. Indeed, when the adjustment of the duct is modified by a rotational movement of the latter about its pivot axis, this has the effect of raising one of the two reservoirs and lowering the second. This results in a difference between the immersion depths in the bath of the two reservoirs. The leveling of the system therefore imposes an adjustment of the entire duct, made complicated by its weight and by its pivoting and retraction systems.

SUMMARY OF THE INVENTION

According to a first aspect of the invention, proposed is a device for removing mattes from the surface of a liquid metal bath inside a duct of a line for continuously coating a metal strip having first and second faces, the first face being intended to come into contact with a bottom roller, comprising a compartment forming a reservoir via which the liquid metal inside the duct is replenished by being drawn off by a pump to which the compartment is connected, characterized in that the compartment is fixed to a support by attachment and adjustment means and is capable of being removed by disassembly means without the metal strip needing to be cut.

Advantageously, the compartment is arranged, relative to the metal strip, on the side of the first face.

According to one possibility, the device comprises a second compartment arranged, with respect to the metal strip, on the side of the second face. The position of the two compartments, in particular their horizontality, can be adjusted independently of each other.

Preferably, the compartment is separable from the duct.

According to one embodiment, the compartment can be held by two arms connected to the duct by attachment and adjustment means.

According to a variant, the compartment can be held by two arms connected to the pot containing the liquid metal bath by attachment and adjustment means.

According to another possibility, the compartment can be held by two arms connected to a support structure external to the pot containing the liquid metal bath by attachment and adjustment means.

Advantageously, the device according to the first aspect of the invention may comprise means for adjusting the position of the compartment independent of means for adjusting the duct.

According to one embodiment, each lateral end of the compartment is connected to a position indicator flush with the surface of the bath outside the duct when the position of the compartment, in particular its horizontality, is correctly adjusted.

The device can also be equipped with a camera placed in the duct and making it possible to view a surface of the bath inside the latter. The compartment may comprise at least one indicator of the position of a front face of the compartment relative to the metal strip emerging from the surface of the bath visible by the camera, said position indicator being connected to a position indicator flush with the surface of the bath outside the duct when the position of the compartment, in particular its horizontality, is correctly adjusted.

According to a second aspect of the invention, proposed is a continuous coating line comprising a duct and a pot arranged to receive a liquid metal bath, further comprising a device for removing mattes according to the first aspect of the invention, or one or more of its improvements.

According to a third aspect of the invention, provided is a matte removal method for removing mattes from the surface of a liquid metal bath inside a duct of a line for continuously coating a metal strip, comprising a compartment forming a reservoir through which the liquid metal present inside the duct is replenished by drawing off by a pump to which it is connected, comprising a step of removing said compartment not comprising a step for cutting the metal strip.

BRIEF DESCRIPTION OF THE FIGURES

Other features and advantages of the invention will become apparent from the detailed description that follows, for the understanding of which reference is made to the appended drawings, in which:

FIG. 1 is a schematic side sectional view of a coating section according to the state of the art.

FIG. 2 is a schematic view in side section of a coating section according to an embodiment of the invention.

FIG. 3 is a schematic view in front section of a coating section according to the embodiment of the invention of FIG. 2.

FIG. 4 is a schematic view in front section of a coating section according to a second embodiment of the invention.

Since the embodiments described hereinafter are not limiting in nature, it is possible in particular to consider variants of the invention that comprise only a selection of the features that are described, provided that this selection of features is sufficient to confer a technical advantage or to differentiate the invention from the prior art. This selection comprises at least one preferably functional feature without structural details, or with only a portion of the structural details if this portion alone is sufficient to confer a technical advantage or to differentiate the invention from the prior art.

In the remainder of the description, elements having an identical structure or similar functions will be designated by the same references.

DETAILED DESCRIPTION OF THE INVENTION

FIG. 2 illustrates, schematically and in side section, a coating section according to a first embodiment of the invention. In this example, an independent compartment 50 forms a reservoir separate from a shoe 40. It is partially placed inside the latter. It is arranged on the side of the face of the strip that comes into contact with the bottom roller 11. It is in fact on this face that it is necessary to prevent the mattes from being carried away by the strip before becoming wedged between the strip and the bottom roller. A discharge pump, not shown in this figure, sucks up the molten metal in the compartment 50 and pushes it back into the pot 8. Arrows 10 illustrate the flow of molten metal in the vicinity of the compartment.

In a variant embodiment that is not shown, a second independent compartment is placed on the other face of the strip, opposite the first, so as to accentuate the replenishment of the bath inside the shoe. The two compartments are then separate from each other and supported separately so that they can be removed without it being necessary to cut the strip. Thus, one compartment can be removed while the second remains in place. They are also adjustable independently of each other so as to adjust the position of one, relative to the surface of the bath and to the strip, without affecting the second. Thus, for example, the distance between the compartment and the strip may be different on the two faces of the strip. Advantageously, the two compartments are connected by at least one hydraulic connection so that a single pump is sufficient to suck up the molten metal present in the two compartments. This hydraulic connection comprises a flexible section allowing relative movement between the two compartments. It also comprises an easily disconnectable connecting means to facilitate the removal of the independent compartments and the equipment associated therewith.

FIG. 3 again schematically illustrates the embodiment of the invention according to FIG. 2, but this time with a front sectional view passing through the independent reservoir. To simplify this view, the strip 1 is shown schematically by a band and the bottom roller is not shown.

The independent compartment 50 extends over the width of the shoe 40 so that its length is at least equal to the width of the strip. It is mechanically connected to two side arms 13 arranged laterally on either side of the duct 3 and becoming fixed on the latter, or on the shoe 40, by an attachment and adjustment means 14. The attachment and adjustment means 14 is a means of removing the independent compartment 50.

The attachment and adjustment means 14 make it possible to independently adjust the relative lateral and top and bottom positions of each arm with respect to the duct. They allow the horizontality of the compartment 50 independently of the horizontality of the shoe and independently of the distance between the independent compartment and the strip. The attachment and adjustment means 14 make it possible to adjust the immersion depth in the bath of the compartment 50, with a fine adjustment making it possible to precisely adjust the latter at each of the lateral ends of the compartment. They also make it possible to precisely adjust a distance L between an upper edge 25 (FIG. 2), also called a blade, of the front face of the compartment, which is located in the vicinity of the strip 1, and the strip. The side arms 13 each comprise a position indicator 15 (FIG. 3). These position indicators 15 are arranged on the side arms 13 at the height at which the arms must be immersed in the bath 2. They allow adjustment of the horizontality of the independent compartment 50 by being flush with these position indicators 15 on the surface of the bath. Thus, using the attachment and adjustment means 14, it is easy to adjust the position of the arms, and therefore that of the independent compartment 50, without having visibility of the latter.

As shown in FIG. 2, the adjustment is made so that the upper edge 25 (the blade) of the front face of the independent compartment 50 is located at a height P of between 0 and 20 millimeters below the surface of the molten metal bath 2 in the duct 3, when the latter is in the working position in the pot 8. The rear face of the independent compartment is higher than the blade of the front face by a height h of at least 20 millimeters. The bottom of the independent compartment is deeper than the bottom of the shoe by a height H of at least 20 millimeters. The distance L between the upper edge 25 of the compartment 50 and the strip is for example between 10 and 50 mm. On the height of the compartment, the distance between its outer wall and the strip may be different. It thus has a distance L at the upper edge 25 of the compartment and a distance greater than L at the bottom of the compartment, thus forming a clearance angle limiting the risk of contact between the strip and the compartment.

At least one pump 17 (FIG. 3), the suction of which is connected inside the compartment 50 by a pipe 18 and the discharge of which opens into the pot 8 by a discharge pipe 19, allows the replenishment of the molten metal bath inside the compartment 50 and therefore the shoe 40. In FIG. 3, the suction pipe 18 is connected to the independent compartment 50 at its end close to the pump. It can be connected at any other point, for example in the middle of the length of the compartment. As a variant, the suction pipe 18 can be connected at least at two distinct points, for example with a point in the vicinity of each end of the independent compartment. The pump can operate at constant flow, with a flow comprised for example between 100 and 300 l/min. The flow rate of the pump can also be adjusted according to the width and running speed of the strip as well as according to the grammage of metal carried by the strip.

A camera 30 (FIG. 2) is placed inside the duct 3. This camera transmits a video of the surface of the bath in the duct to the line's control room. The operator can thus judge the quantity of mattes present in the duct and therefore the efficiency of the current toward the independent compartment. If necessary, the operator can modify at least one operating parameter of the installation, for example the flow rate of the pump, to obtain the desired efficiency. Using the camera, the operator can also check the pass line and the profile of the strip, for example the presence of a transverse chain, when it dips into the bath. If necessary, the operator can thus adjust the distance L between the upper edge 25 of the compartment 50 and the strip 1. To help him visualize the position of the compartment 50 relative to the strip, the latter comprises at least one position indicator 24 emerging from the surface of the bath, for example corresponding to an extension of the front face of the compartment, as shown schematically in FIG. 2. Advantageously, the compartment 50 comprises 3 position indicators 24, one at each end of the compartment and another in the center thereof, as shown in FIG. 3. The operator can thus adjust the position of the compartment 50 when the strip is not perfectly parallel to the duct in order to keep a distance L between the upper edge 25 of the compartment and the strip constant over the width of the strip. In the case where the device according to the invention comprises two compartments, one on each face of the strip, these may be adjustable independently of each other.

The pump is designed to be disassembled without tools and in production. It is held mechanically by one of the side arms 13, directly or indirectly, for example via the pipe 18. The independent compartment 50 can also be mechanically connected to this first arm 13 by this same pipe 18. It can be connected to the second arm 13 by a mechanical connection 20 similar to that obtained by the pipe 18. As a result, the independent compartment, the pump and the suction 18 and discharge 19 pipes form an assembly that can be assembled, dismantled and adjusted via the attachment and adjustment means 14, independently of the position of the duct 3 and the shoe 40. The mounting and disassembly of this assembly does not require cutting the strip.

The compartment has a lifespan of a few weeks whereas a shoe, due in particular to its thickness, has a lifespan of a few months. According to the state of the art, the compartment is secured to the shoe. This solution is therefore costly in terms of maintenance, since it requires scrapping the shoe more frequently than necessary. According to the invention, it is possible to replace the independent compartment, or any other element associated therewith, with a periodicity different from that of the shoe.

As a variant, the equipment comprises a second pump, for example placed at the other end of the independent compartment. It is then held mechanically by the other side arm 13, directly or indirectly. This second pump has its own suction 18 and discharge 19 pipes, separate from those of the first pump. Having two pumps can have advantages, for example a better balance of the masses on the duct. Additionally, smaller sized pumps are more readily available and with a wider choice of potential suppliers. Having two pumps also makes it possible to operate in degraded mode in the event of failure of one of the two pumps.

The current of molten metal inside the shoe, caused by the suction of the pump, or of the two pumps, makes it possible to remove the mattes toward the independent compartment before being removed from the independent compartment, in the pot 8, by the pump 17. The horizontality of the independent compartment is therefore important to have a homogeneous flow of molten metal all along the strip; this is made possible by the attachment and adjustment system 14. The external position indicator 15, on each side of the compartment, allows the operator of the installation to view the position of the latter and to correct it if necessary. As the strip consumes molten metal, it lowers the level of molten metal in the pot 8. To compensate for this, metal is added by immersing ingots in the bath. A means 21 for measuring the height of the bath allows the height of the bath to be controlled. For example, the measuring means 21 is a measuring laser that points from above on the level of molten metal in the pot 8. When the measuring means 21 detects a low level, equipment for loading molten metal ingots performs an ingot lowering step into the pot of molten metal, which results in raising the level in the pot.

The independent compartment as well as the other elements in contact with the liquid bath, in particular the pump 17 and its suction and discharge pipes, are made of stainless steel of the 316L type.

FIG. 4 illustrates a second embodiment of the invention with a schematic representation similar to that of FIG. 3. In this example with two pumps 17, the independent compartment 50 and all the elements attached to it, such as the pumps and their drawing off 18 and discharge 19 pipes, are mechanically connected to the pot 8 by arms 23 and attachment and adjustment means 22. There is thus no longer any mechanical connection between the compartment 50 and the elements that are attached to it and the duct 3. The position of the compartment 50 on the one hand and that of the duct on the other hand can be adjusted independently of each other without interfering with each other. When the duct is retracted, the system linked to the compartment 50 is then visible, facilitating the horizontality adjustment via the adjustment means 23.

According to a variant embodiment not shown, the independent compartment 50, and the elements that are attached to it, are mechanically connected to a support structure external to the pot 8.

The solutions for which the independent compartment, and the elements that are attached to it, are mechanically connected to the pot 8 or to a structure external to the latter are particularly advantageous for the addition of a matte removal device on an installation that did not comprise one. Thus, the duct can be retained, no additional weight being added to it.

As will be readily understood, the invention is not limited to the examples that have just been described, and numerous modifications may be made to these examples without departing from the scope of the invention. In addition, the various features, forms, variants, and embodiments of the invention may be grouped together in various combinations as long as they are not incompatible or mutually exclusive.

The invention claimed is:

1. Device for removing mattes from the surface of a liquid metal bath inside a duct of a line for continuously coating a metal strip having first and second faces, the first face configured to come into contact with a bottom roller, the first face comprising a compartment forming a reservoir via which the liquid metal inside the duct is replenished by being drawn off by a pump to which the compartment is connected, wherein the compartment is fixed to a support by an attachment and adjustment means and the compartment is configured to be removed by a disassembly means without the metal strip needing to be cut and the compartment is held by two arms connected to the duct by the attachment and adjustment means.

2. Device according to claim 1, wherein the compartment is arranged, relative to the metal strip, on the side of the first face.

3. Device according to claim 1, comprising a second compartment arranged, relative to the metal strip, on the side of the second face, the horizontality position of the two compartments being adjustable independently of each other.

4. Device according to claim 1, wherein the compartment is separable from the duct.

5. Device according to claim 1, wherein the compartment is held by two arms connected to a support structure external to the pot containing the liquid metal bath by the attachment and adjustment means.

6. Device according to claim 1, comprising means for adjusting the position of the compartment independent of means for adjusting the duct.

7. Device according to claim 1, wherein each lateral end of the compartment is connected to a position indicator flush with the surface of the bath outside the duct when the horizontality position of the compartment is correctly adjusted.

8. Device according to claim 1, comprising a camera placed in the duct and making it possible to view a surface of the bath inside the latter, in which the compartment comprises at least one indicator of the position of a front face of the compartment relative to the metal strip emerging from the surface of the bath visible by the camera, said position indicator being connected to a position indicator flush with the surface of the bath outside the duct when the horizontality position of the compartment is correctly adjusted.

9. Continuous coating line comprising a duct and a pot arranged to receive a liquid metal bath, wherein that it further comprises a device for removing mattes according to claim 1.

10. Matte removal method for removing mattes from the surface of a liquid metal bath inside a duct of a line for continuously coating a metal strip, comprising a compartment forming a reservoir through which the liquid metal present inside the duct is replenished by drawing off by a pump to which it is connected, wherein that it comprises a step of fixing the compartment to a support by an attachment and adjustment means, a step of removing said compartment not comprising a step for cutting the metal strip and a step of holding said compartment by two arms connected to the duct by the attachment and adjustment means.

* * * * *